US009512569B1

(12) United States Patent
Meng Jun et al.

(10) Patent No.: US 9,512,569 B1
(45) Date of Patent: Dec. 6, 2016

(54) FORMULATION OF OPTICAL BRIGHTENERS FOR PAPERMAKING

(71) Applicants: Li Meng Jun, Surrey (CA); Li Eric Ji Wei, Surrey (CA)

(72) Inventors: Li Meng Jun, Surrey (CA); Li Eric Ji Wei, Surrey (CA)

( * ) Notice: Subject to any disclaimer, the term of this patent is extended or adjusted under 35 U.S.C. 154(b) by 0 days.

(21) Appl. No.: 15/006,956

(22) Filed: Jan. 26, 2016

(51) Int. Cl.

| | |
|---|---|
| ***D21H 21/30*** | (2006.01) |
| ***D21H 17/09*** | (2006.01) |
| ***D21H 17/36*** | (2006.01) |
| ***D21H 17/25*** | (2006.01) |
| ***D21H 17/06*** | (2006.01) |
| *C09K 11/06* | (2006.01) |
| *D21H 17/07* | (2006.01) |

(52) U.S. Cl.
CPC ..... *D21H 21/30* (2013.01); *D21H 17/06* (2013.01); *D21H 17/09* (2013.01); *D21H 17/25* (2013.01); *D21H 17/36* (2013.01)

(58) Field of Classification Search
CPC ..... D21H 21/30; D21H 17/07; C09K 11/06
USPC ..... 8/442, 552, 611, 648, 680, 919, 916; 106/163.01, 206.1; 252/301.23; 413/10; 428/32.1; 524/47, 158, 387, 425, 425.1, 524/431, 436, 444, 446, 503, 511, 557, 803; 544/193.2, 113
See application file for complete search history.

(56) References Cited

U.S. PATENT DOCUMENTS

| | | | | |
|---|---|---|---|---|
| 5,057,570 | A * | 10/1991 | Miller | D21H 19/60 524/425 |
| 5,830,241 | A * | 11/1998 | Rohringer | C11D 1/72 8/552 |
| 6,521,701 | B2 * | 2/2003 | Egraz | D21H 19/60 428/425.1 |
| 6,620,294 | B1 * | 9/2003 | Jokinen | C08K 5/0041 162/135 |
| 2009/0281221 | A1 * | 11/2009 | Letzelter | D21H 21/30 524/387 |
| 2010/0181536 | A1 * | 7/2010 | Gauto | C08K 5/0041 252/301.23 |
| 2011/0281042 | A1 * | 11/2011 | Wild | D21H 19/60 428/32.1 |

FOREIGN PATENT DOCUMENTS

| | | | | |
|---|---|---|---|---|
| CA | 2547469 | A1 * | 6/2005 | C08K 5/00 |

* cited by examiner

*Primary Examiner* — Bijan Ahvazi

(57) ABSTRACT

This invention relates to a formulation of optical brightener, polyvinyl alcohol, glucomannan, carboxymethyl cellulose, and sorbitol which can be used on the sizing or coating application of papermaking. This composition yields high whiteness and brightness on the product paper.

1 Claim, No Drawings

FORMULATION OF OPTICAL BRIGHTENERS FOR PAPERMAKING

CROSS-REFERENCE TO RELATED APPLICATIONS

In the following references of related patents, the suggested formulations or compositions do not include the use of glucomannan for the purpose as an optical brightener (OBA) carrier.

U.S. Pat. No. 5,830,241A proposes a liquid formulation using polyethylene glycol and polyvinyl alcohol (PVOH) as carriers on OBA to improve brightness.

U.S. Pat. No. 5,057,570 explores the use of low viscosity and partially hydrolyzed polyvinyl alcohol as a carrier for OBA without the requirement of cooking.

U.S. Pat. No. 6,620,294B1 discusses a formulation using completely polyvinyl acetate-saponified polyvinyl alcohol as a carrier for OBA with 55° C. heating.

US20110281042 claims a method of making printing paper using OBA, PVOH, and divalent salt to improve the inkjet printing quality of ColorLok papers.

CN101466897B reveals a method of increasing OBA stability by using carriers comprising of PVOH, sorbitol and carboxymethyl cellulose (CMC).

U.S. Pat. No. 6,521,701B2 presents a stable aqueous liquid polymer composition that includes low viscosity and partially hydrolyzed PVOH with a water-soluble polymer for the purpose of improving activation of OBA and the viscosity and water-retention capability of paper coating colors.

WO2005/056658 proposes an improved method of preparing liquid coating compositions comprising of OBA and PVOH by blending and cooking.

CA2655454A1 uncovers a storage-stable, low viscosity aqueous composition comprising of OBA and PVOH that is pumpable for the use on high brightness coated paper.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM

Not applicable.

BACKGROUND OF THE INVENTION

It is common knowledge in the papermaking industry that sizing and coating brightness can be significantly improved by the addition of optical brighteners. Optical brighteners also known as OBAs work closely with sizing agents and starch to stay in the coating and sizing matrix. When observed under light, OBAs can absorb invisible ultraviolet light and re-emit visible blue light back, giving viewers the visual perception of a brighter sheet.

Over the past decades, there has been an increasing demand for coated paper of higher brightness. With the addition dosage of OBA growing to satisfy this need, side-effects are observed.

Conventional tetra-sulfonated stilbene optical brightener has a relatively lower cost compared to most others. However only 15 lb/ton maximum addition can be made to the coating/sizing before overdosing occurs which leads to sheet yellowing and over-greening. Even though fluorescence gains will continue to rise, whiteness and brightness will drop.

To combat this effect, further brightness gains has to be obtained from using conventional hexa-sulfonated stilbene OBA which can be added on top for another 20-30 lb/ton before similar effects can be observed. The downside of using this product is the high cost associated with this compound.

In addition, the effect of OBA addition on sizing/coating alone is not optimal. When the hot base sheet is fed through the coater or size press, the optical brightener gets absorbed from sizing/coating medium into the sheet fibres, which prevents proper OBA functions to some extent. It is by the mechanism that the coating/sizing composition has a natural tendency to transfer onto the base sheet all or part of the water and along with the water-soluble materials it contains. Therefore, the characteristic of water retention in the medium is highly sought after.

Often, papermakers utilizes carriers to increase the effectiveness of optical brightener by increasing its retention to stay on the medium and the surface of the sheet. The most commonly used carrier is polyvinyl alcohol (PVOH) with a hydrolysis level of ~97-99%. The material needs to be precooked fully in order to be in a usable state for production. There is a cost associated with cooking PVOH at the mill, and purchasing pre-cooked PVOH as liquid form is even more expensive. In many cases, the in house cooking cost is also compounded further with inadequate equipment or poorly trained operators.

Papermakers occasionally also choose other natural or synthetic additives to improve the OBA and water retention. Carboxymethyl cellulose (CMC), starch, and other polymers are used. These additives do not degrade paper quality, and can even add improvements to gloss, wet strength, and smoothness.

SUMMARY OF THE INVENTION

This invention uses a mixture of conventional and non-conventional carriers to optimize optical brightener retention performance on coating and sizing.

The formulation includes the optical brightener, polyvinyl alcohol, glucomannan, carboxymethyl cellulose, and sorbitol. These complementary elements gives noticeable retention power to OBA, yielding significant OBA dosage reduction along with other benefits such as lower additive viscosity and reinforced bonding to the sizing/coating medium.

Since tetra-sulfonated OBA is notorious for greening-over when approaching brightness plateau, by using this formulation to reduce OBA addition rate while maintaining the same brightness gain is not only beneficial in cost, but also allows room to push brightness targets higher for future grade developments.

In addition to brightness gains, the formulation also results in improved whiteness when measured for the L* value of LAB color space due to the components of the formulation having a much smaller impact on tint. This property can often be beneficial to inkjet printing. The carriers present in the formulation mix also provide the OBA some resistance against light-induced aging, which is very common with optical brightener products due to their molecular instability.

Tetra-sulfonated OBA has a natural tendency to naturally exhibit a yellow color regardless of the medium applied on. Hexa-sulfonated OBA exhibits minor redness, with no yellowing problem. Inside this formulation, the additives are capable of removing most of these color aberration by preventing the OBA molecules from self-stacking.

The polyvinyl alcohol used preferably would have low liquid viscosity around 3-4 cps at 4% concentration and molar degree of hydrolysis of 85-89%. These characteristics allow even dispersion of formulation content as well as the removal of requirement to prep the PVOH prior to use. No external heating is required and the whole formulation mix can be added as a dry solid to the aqueous pigment/sizing dispersion accompanied with high shear stirring for 15-20 minutes. This process removes the introduction of extra water which is added during the cooking process into the coating/sizing medium, reducing its effective solid content.

Sorbitol is a common ingredient in the food industry as a sweetener. However its purpose in the invention is acting as an OBA carrier as well as to lower the liquid viscosity of the medium it resides in, effectively solving the common thickness problem presented by the PVOH. If the viscosity of the coating/sizing medium falls too low to meet papermaking standards, there is always thickener on site to adjust accordingly.

The high cost of carboxymethyl cellulose deters papermakers from any significant application of the compound. A small amount included with the formulation assists as a carrier for OBA and improves the sizing/coating medium's smoothness and strength.

One of the most important component of the formulation additive is konjac glucomannan (KGM), which is extracted from the root or corm of the konjac plant. This straight chain polymer has the characteristic of emulsifying the formulation mix during use, producing better uniformity and stronger wet strength. Glucomannan is highly dissolvable and offers strong cohesion to other water soluble molecules. Once KGM dissolves, it is difficult for it to air dry out due to the surface strength that provides strong water retention properties. As a compound without charge, impacts on papermaking system and coating/sizing composition is minimal.

DETAILED DESCRIPTION OF THE INVENTION

The invention will be further described with reference to the following non-limiting examples:

Paper brightness is measured with a lab station brightness meter or online paper machine brightness meter, which determines the brightness of a split sheet at a wavelength of 457 nm (ISO or D65 Standard Method).

The OBA formulation consists of 10-70 w/w % optical brightener, 10-70 w/w % polyvinyl alcohol, 0-20 w/w % glucomannan, 0-20 w/w % carboxymethyl cellulose, and 0-20 w/w % sorbitol.

The OBAs described in this invention are the following:

1. Tetra-sulfonated OBA has a chemical name of tetrasodium 4,4'-bis[[4-[bis(2-hydroxyethyl)amino]-6-(4-sulphonatoanilino)-1,3,5-triazin-2-yl]amino]stilbene-2,2'-disulphonate], and a CAS number of 16470-24-9.
2. Hexa-sulfonated OBA has a chemical name of hexasodium 2,2'-[vinylenebis[(3-sulphonato-4,1-phenylene)imino[6-(diethylamino)-1,3,5-triazine-4,2-diyl]imino]]bis(benzene-1,4-disulphonate), and a CAS number of 41098-56-0.
3. FWA 351 OBA has a chemical name of 4,4"-bis(2-sulfostyryl)biphenyl disodium salt, and a CAS number of 27344-41-8.
4. FWA 71 OBA has a chemical name of disodium 4,4'-bis[(4-anilino-6-morpholino-1,3,5-triazin-2-yl)amino]stilbene-2,2'-disulphonate, and a CAS number of 16090-02-1.

Example 1

Mill Study

The mill produces copy/bond paper with 100% Kraft pulp. The brightness of the sheet is measured before it is passed through the size press, and then once more before it is on the final reel. The sizing medium is mainly modified corn starch.

An incoming base sheet brightness of 91% D65 was determined to be constant. Performance data of conventional tetra- and hexa-sulfonated OBAs versus this formulation is displayed below in Table 1.

Formulation used contains by weight 23% tetra-sulfonated OBA, 63% PVOH, 7% KGM, 4.5% CMC, and 2.5% sorbitol.

TABLE 1

| Addition Rate at Size Press (lb/ton) | Final D65 Brightness (tetra OBA) | Final D65 Brightness (hexa OBA) | Final D65 Brightness (formulation) |
|---|---|---|---|
| 0 | 91.0 | 91.0 | 91.0 |
| 1.0 | 94.8 | 100.1 | 105.2 |
| 2.5 | 101.2 | 107.3 | 111.3 |
| 5.0 | 108.5 | 112.1 | 114.4 |
| 10 | 111.4 | 114.5 | 115.1 |
| 15 | 110.1 | 114.8 | 115.7 |

From the trend provided by this table, one can observe the brightness development is significantly higher on the formulation mix, and more effective in the smaller addition rates. At the 15 lb/ton dosage mark, yellowing and greening over is also evident with the conventional tetra-sulfonated OBA, as a drop in brightness is experienced.

Example 2

Mill Study

The mill produces coated paper with mostly Kraft and a smaller percentage of mechanical pulp. The brightness of the sheet is measured before it is coated, and then once again before it is on the final reel. Coating medium includes latex, clay, and starch. Coat weight is 22 g.

Incoming base sheet brightness of 72 ISO is constant. Data of conventional tetra- and hexa-sulfonated OBA vs the formulation mix performance is displayed below in Table 2.

Formulation used contains by weight 50% FWA 71 OBA, 30% PVOH, 12% KGM, 0.5% CMC, and 7.5% sorbitol.

TABLE 2

| Addition Rate at Coater (parts) | Final ISO Brightness (tetra OBA) | Final ISO Brightness (hexa OBA) | Final ISO Brightness (formulation) |
|---|---|---|---|
| 0 | 72.0 | 72.0 | 72.0 |
| 0.5 | 74.5 | 75.4 | 76.1 |
| 1.0 | 80.2 | 82.6 | 83.4 |
| 1.5 | 83.1 | 85.7 | 86.6 |
| 2.0 | 84.8 | 87.0 | 88.0 |
| 2.5 | 85.3 | 88.5 | 89.2 |

It is evident that at the formulation mix achieves a faster brightness buildup. At 2.5 parts addition, conventional tetra-sulfonated OBA starts to experience plateauing effect with diminished brightness gains.

Example 3

Laboratory Study

Samples of base sheet with no sizing applied were obtained from a mill that produces copy paper. Modified corn starch at 15% consistency was cooked and with OBA added to the medium before applied on base sheet with a manual coating rod.

L* whiteness values development can be observed in Table 3.

Formulation used contains by weight 65% hexa-sulfonated OBA, 10% PVOH, 4% KGM, 4% CMC, and 17% sorbitol.

TABLE 3

| Addition to Sizing Medium (parts) | L* value (tetra OBA) | L* value (hexa OBA) | L* value (formulation) |
|---|---|---|---|
| 0 | 83 | 83 | 83 |
| 1.0 | 87 | 89 | 90 |
| 2.0 | 90 | 93 | 95 |

The sheets that are treated with the formulation OBA additives contain better whiteness than sheets treated with just conventional OBA.

Example 4

Laboratory Study

Samples of base sheet with no sizing applied were obtained from a mill that produces copy paper. Modified corn starch at 15% consistency was cooked with OBA formulation added to the medium before applied on base sheet with a manual coating rod.

Sample 2 contains the complete OBA formulation by weight with 20% FWA 351 OBA, 20% PVOH, 20% KGM, 20% CMC, and 20% sorbitol.

Sample 1 contains the same ratio of OBA formulation as in Sample 2 but with the glucomannan (KGM) component removed (0%).

TABLE 4

| Addition to Sizing Medium (parts) | Brightness (D65) Sample 1 | Brightness (D65) Sample 2 |
|---|---|---|
| 1.0 | 103.5 | 105.1 |
| 2.0 | 107.9 | 109.8 |

It is evident from Table 4 that from the addition of glucomannan, the retention property of the OBA increases even further.

What is claimed is:

1. An optical brightener formulation consisting of (a) 10-70 w/w % optical brightener is selected from a group consisting of (i) tetrasodium 4,4'-bis[[4-[bis(2-hydroxyethyl)amino]-6-(4-sulphonatoanilino)-1,3,5-triazin-2-yl]amino] stilbene-2,2'-disulphonate], (ii) hexasodium 2,2'-[vinylenebis[(3-sulphonato-4,1-phenylene)imino[6-(diethylamino)-1,3,5-triazine-4,2-diyl]imino]]ibis(benzene-1,4-disulphonate, (iii) 4,4"-bis(2-sulfostyryl)biphenyl disodium salt, and (iv) disodium 4,4'-bis[(4-anilino-6-morpholino-1,3,5-triazin-2-yl)amino]stilbene-2,2'-disulphonate based on the total sum of the optical brightener formulation;

(b) 10-70 w/w % polyvinyl alcohol based on the total sum of the optical brightener formulation;

(c) 1-20 w/w % glucomannan based on the total sum of the optical brightener formulation;

(d) 0.5-20 w/w % carboxymethyl cellulose based on the total sum of the optical brightener formulation; and (e) 1-20 w/w % sorbitol based on the total sum of the optical brightener formulation.

* * * * *